US006662789B1

(12) United States Patent
Hatano

(10) Patent No.: US 6,662,789 B1
(45) Date of Patent: Dec. 16, 2003

(54) WATER-COOLED EXHAUST GAS RECIRCULATING DEVICE

(75) Inventor: Kenta Hatano, Tokyo (JP)

(73) Assignee: Mitsubishi Denki Kabushiki, Tokyo (JP)

( * ) Notice: Subject to any disclaimer, the term of this patent is extended or adjusted under 35 U.S.C. 154(b) by 7 days.

(21) Appl. No.: 10/030,696

(22) PCT Filed: Jun. 20, 2000

(86) PCT No.: PCT/JP00/04017

§ 371 (c)(1),
(2), (4) Date: Jan. 14, 2002

(87) PCT Pub. No.: WO01/98647

PCT Pub. Date: Dec. 27, 2001

(51) Int. Cl.[7] ..... F02M 25/07
(52) U.S. Cl. ..... 123/568.12; 123/41.31
(58) Field of Search ..... 123/568.12, 568.11, 123/568.13, 568.14, 568.15, 568.21, 568.23, 568.24, FOR 124, 41.31, 41.01, 41.44, 41.14

(56) References Cited

U.S. PATENT DOCUMENTS

| | | | | |
|---|---|---|---|---|
| 4,134,377 A | * | 1/1979 | Bamsey et al. | 123/568.12 |
| 6,279,552 B1 | * | 8/2001 | Okada et al. | 123/568.2 |
| 6,378,839 B2 | * | 4/2002 | Watanabe et al. | 251/129.11 |
| 6,386,188 B1 | * | 5/2002 | Bender | 123/568.12 |
| 6,505,614 B1 | * | 1/2003 | Hueniken et al. | 123/568.11 |

FOREIGN PATENT DOCUMENTS

JP 6-229329 8/1994

* cited by examiner

*Primary Examiner*—Henry C. Yuen
*Assistant Examiner*—Hyder Ali
(74) *Attorney, Agent, or Firm*—Sughrue Mion, PLLC

(57) ABSTRACT

A water-cooled exhaust gas re-circulation device according to the invention has a hole-open/close mechanism allowing communication with outside air is arranged at a cooling water re-circulation passage cooling an exhaust gas re-circulation valve. A drain bolt is used as the hole-open/close mechanism. The hole-open/close mechanism is arranged at a stopper stopping up a hole formed during manufacturing the cooling water re-circulation passage.

6 Claims, 9 Drawing Sheets

FIG.2 PRIOR ART

WATER-COOLED EXHAUST GAS RECIRCULATING DEVICE

TECHNICAL FIELD

The invention relates to a water-cooled exhaust gas re-circulation device disposed at an exhaust gas re-circulation passage of an internal combustion engine such as engines.

BACKGROUND ART

FIG. 1 illustrates a schematic representation of the whole of a conventional cooling water re-circulation passage arranged at the internal combustion engine. FIG. 2 is a front view of a water-cooled exhaust gas re-circulation device arranged at the conventional cooling water re-circulation of FIG. 1. FIG. 3 is a cross sectional view taken along lines III—III of FIG. 2. FIG. 4 is a cross sectional view of a hole formed at a part of the cooling water re-circulation passage within the water-cooled exhaust gas re-circulation device during a die casting.

In these drawings, a reference numeral 1 denotes a cooling water re-circulation passage, and a reference numeral 2 denotes a water-cooled exhaust gas re-circulation device arranged at the cooling water re-circulation passage 1. A reference numeral 3 denotes a drain bolt independent of other components arranged at the cooling water re-circulation passage 1 close to a cylinder block and constituting a hole communicating the cooling water re-circulation passage 1 and outside air. A reference numeral 4 denotes a radiator preventing the cooling water re-circulated in the cooling water re-circulation passage 1 from increasing the temperature. A reference numeral 5 denotes a drain cock acting as an outlet of the cooling water when the cooling water is changed to new one. A reference numeral 6 denotes a radiator cap controlling an internal pressure of the cooling water re-circulation passage 1. The radiator cap 6 constitutes an air hole, which is close to the radiator when the cooling water is changed to new one, and an inlet of the cooling water when the cooling water is supplied to the cooling water re-circulation passage 1. A reference numeral 7 denotes a cylinder block constituting an external engine. A reference numeral 8 denotes a water pump arranged in the cooling water re-circulation passage 1 and supplying the cooling water to the cylinder block 7 of the engine in order to re-circulate it in the cooling water re-circulation passage 1.

The water-cooled exhaust gas re-circulation device 2 includes a valve housing 10 including an exhaust gas re-circulation valve (not shown) and a motor main body 11 including a motor driving the exhaust gas re-circulation valve as shown in FIG. 2 and FIG. 3. The motor main body 11 is affixed to the valve housing 10 with screws 12. A reference numeral 13 denotes a terminal supplying electric power to the motor (not shown) arranged in the motor main body 11. Reference numerals 14 and 15 denote inlet and outlet of an exhaust gas re-circulation passage, which is opened and closed due to the exhaust gas re-circulation valve. A reference numeral 16 denotes a nipple guiding the cooling water from the cooling water re-circulation passage 1, which is close to the engine, to the cooling water re-circulation passage 1 within the water-cooled exhaust gas re-circulation device 2. When the cooling water re-circulation passage 1 in the water-cooled is manufactured due to the die casting, it is necessary to form a hole 17 arranged at a part of the passage 1 as shown in FIG. 4. With a conventional constitution, the hole 17 was filled with a plug 18 as shown in FIG. 3.

With the cooling water re-circulation passage 1, when the cooling water is changed to new one, the drain cock 5 arranged at a lower section of the radiator 4 is used as a discharge port of the cooling water and the radiator cap 6 mounted on an upper section of the radiator 4 is used as the air hole.

First, as shown in FIG. 1, to discharge the cooling water to change it to new one, the temperature of the cooling water is adequately reduced after stopping the engine. With the state, while adjusting an internal pressure of the cooling water re-circulation passage 1 due to open/close of the radiator cap 6, the radiator cap 6 is opened to introduce air to the cooling water re-circulation passage 1. The drain cock 5 is then opened to discharge the cooling water. The drain bolt 3 acting as the air hole close to the engine is opened and the cooling water close to the engine is conveyed toward the radiator to discharge it to outside through the drain cock 5.

Next, to supply the cooling water to the passage 1, the required amount of the cooling water is supplied to the passage 1 through the radiator cap 6 after the drain cock 5 is closed. When the cooling water is supplied, the drain bolt 3 acts as an air hole discharging smoothly air in the cooling water re-circulation passage 1 to outside.

With the conventional structure, it is possible to smoothly discharge the cooling water, which is close to the radiator 4, of the cooling water re-circulation passage 1 due to the radiator cap 6. It is further possible to smoothly discharge the cooling water, which is close to the engine having a complex structure, due to the drain bolt 3 arranged at a position higher than the engine side.

However, since the drain bolt 3 is arranged independently at the conventional cooling water re-circulation passage 1, the conventional water-cooled exhaust gas re-circulation device has a complex layout to produce a redundant space and parts.

The invention was made to solve the foregoing problems. An object of the invention is to provide a water-cooled exhaust gas re-circulation device allowing simplifying the layout of the cooling water re-circulation passage and reducing costs due to reducing a component count and saving a space.

DISCLOSURE OF THE INVENTION

A water-cooled exhaust gas re-circulation device according to the invention is characterized in that a hole open/close mechanism allowing communication with outside air is arranged at a cooling water re-circulation passage cooling an exhaust gas re-circulation valve. In this way, since the cooling water re-circulation passage is integrated with the hole-open/close mechanism, it is possible to remove the drain bolt arranged independently of the exhaust gas re-circulation valve. It is possible to allow saving space, simplifying the structure and reducing a component count.

With the above arrangement, the water-cooled exhaust gas re-circulation device is characterized in that the hole-open/close mechanism is a drain bolt. In this way, even if an interference substance is close to the drain bolt, it is possible to ensure an air hole with respect to the cooling water re-circulation passage without removing the drain bolt.

With the above arrangement, the water-cooled exhaust gas re-circulation device is characterized in that the hole-open/close mechanism is arranged at a stopper stopping up a hole formed during manufacturing the cooling water re-circulation passage. In this way, it is not necessary to form an exclusive hole at the cooling water re-circulation passage in order to install the hole-open/close mechanism. It is possible to allow reducing costs and saving a space as compared with a case of forming the exclusive hole.

BEST MODES FOR CARRYING OUT THE INVENTION

To explain the invention more in detail, the best modes of carrying out the invention will be described with reference to the accompanying drawings.

EMBODIMENT 1

Figure 1:
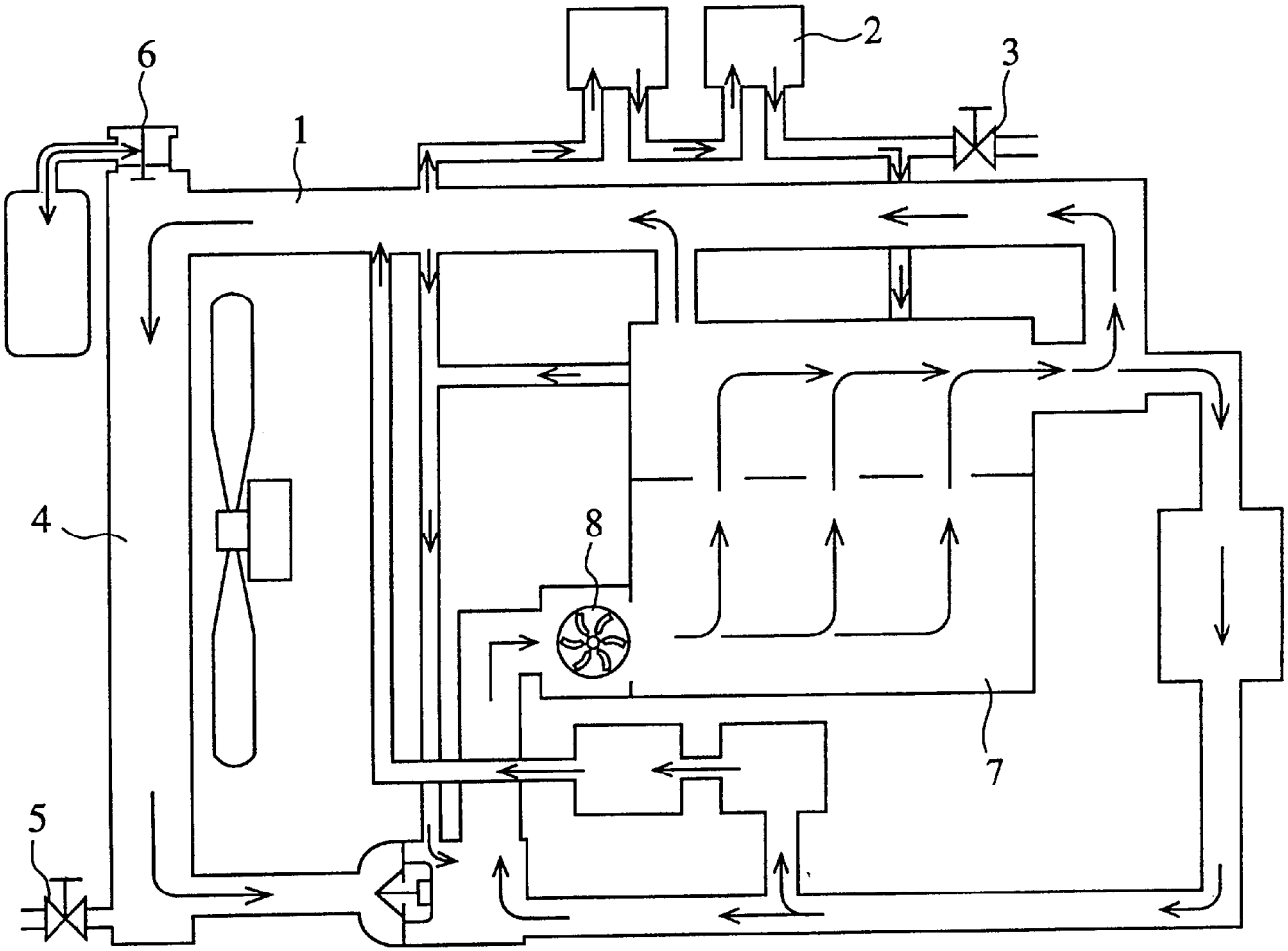
FIG.1 PRIOR ART
FIG. 1 illustrates a schematic representation of the whole of a conventional cooling water re-circulation passage arranged at the internal combustion engine.
Figure 2:
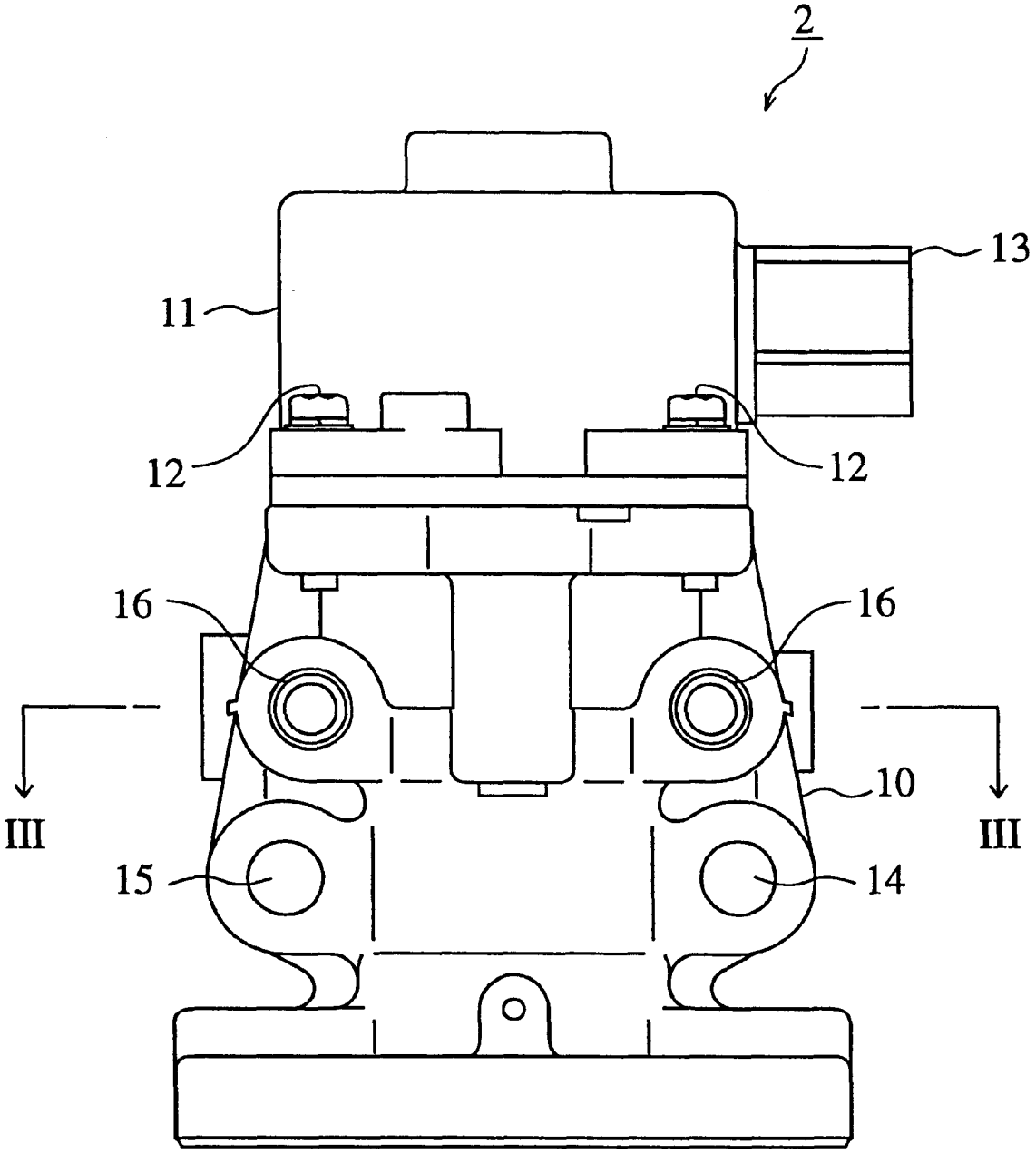
FIG. 2 is a front view of a water-cooled exhaust gas re-circulation device arranged at the conventional cooling water re-circulation of FIG.
Figure 3:
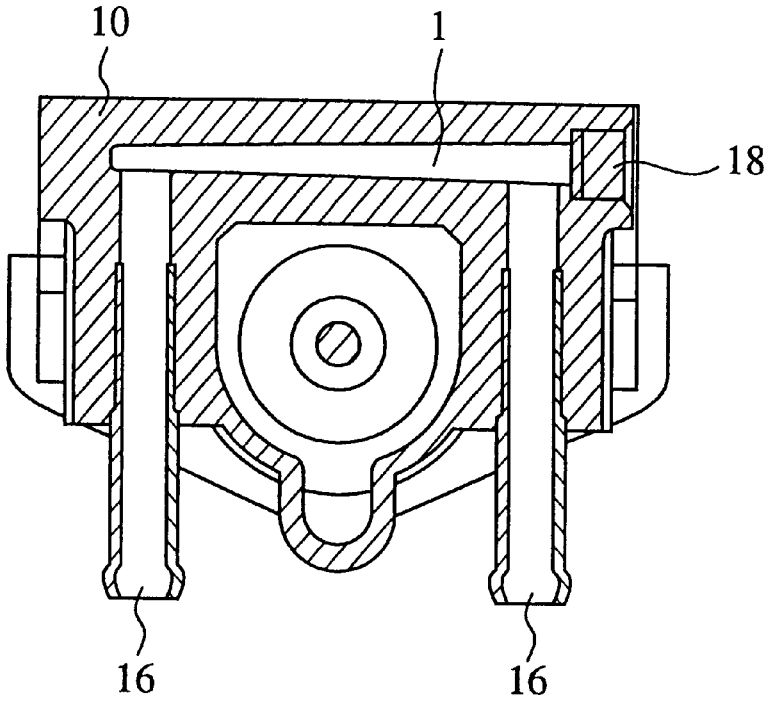
FIG.3 PRIOR ART
FIG. 3 is a cross sectional view taken along lines III—III of FIG. 2.
Figure 4:
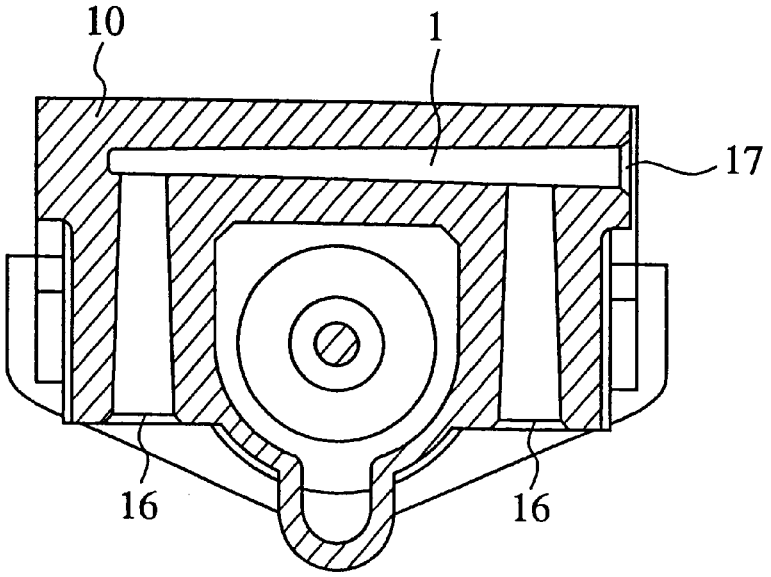
FIG.4 PRIOR ART
FIG. 4 is a cross sectional view of a hole formed at a part of the cooling water re-circulation passage within the water-cooled exhaust gas re-circulation device during a die casting.
Figure 5:
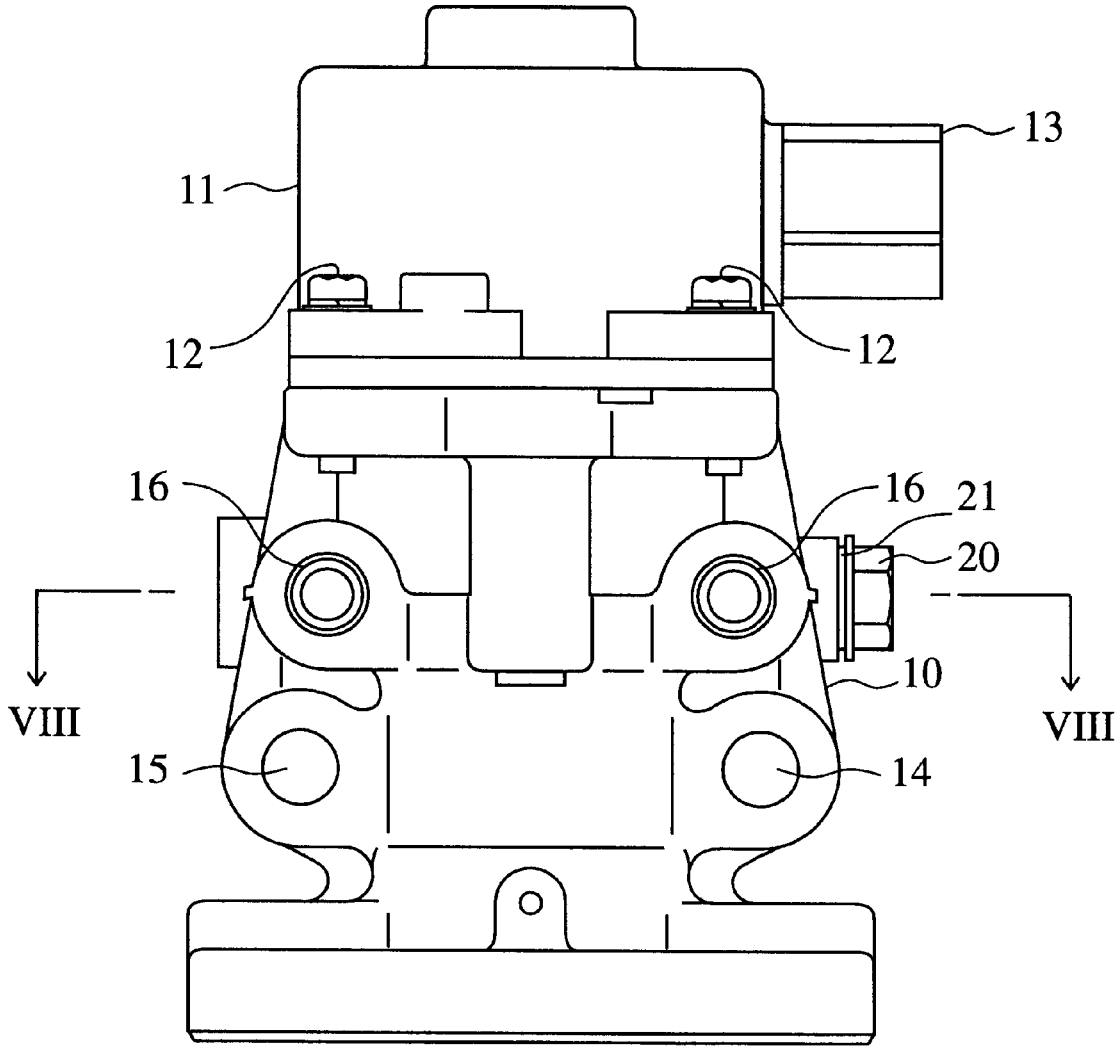
FIG. 5 is a front view of a water-cooled exhaust gas re-circulation device as embodiment 1 according to the invention.
Figure 6:
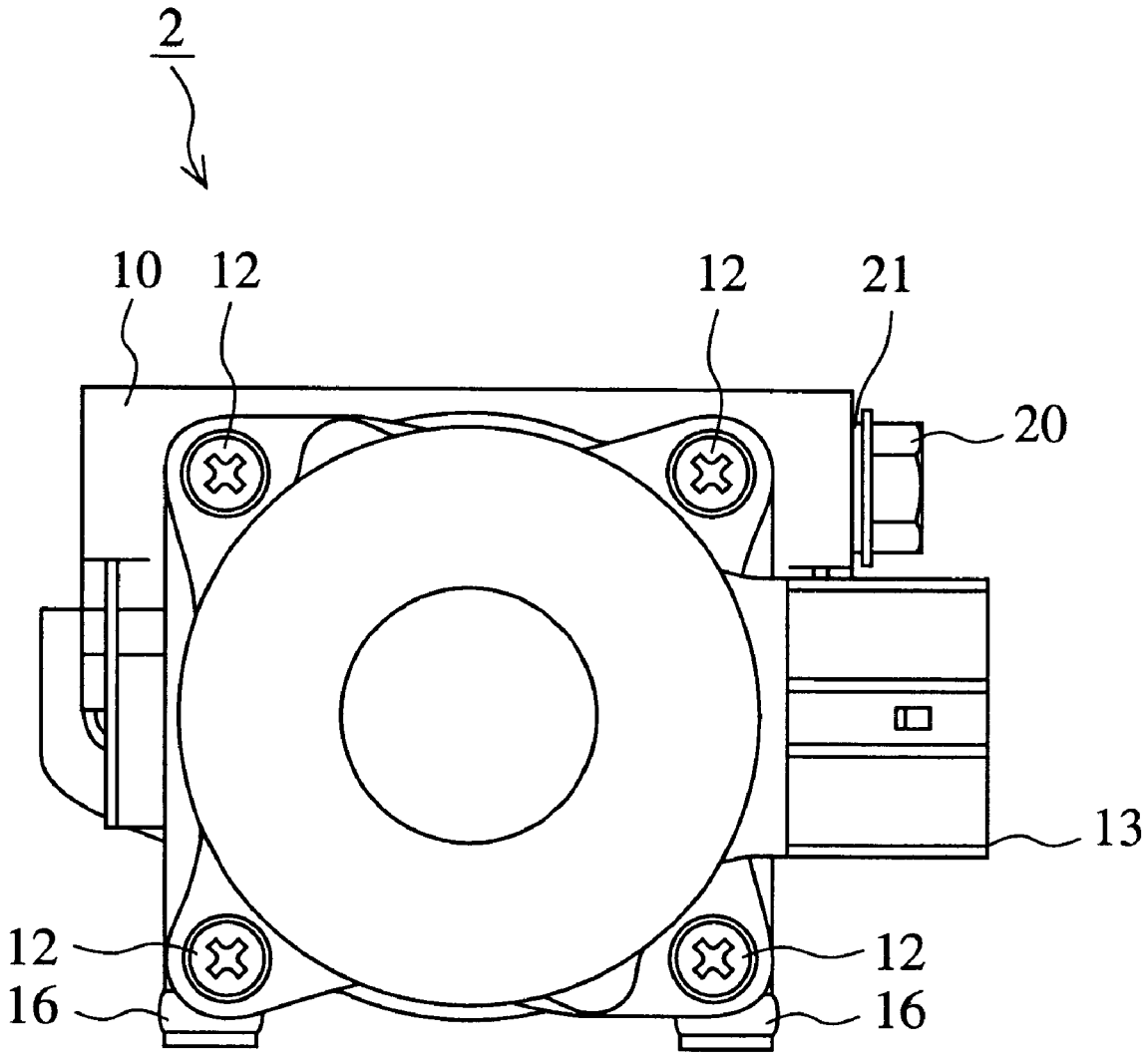
FIG. 6 is a plan view of the water-cooled exhaust gas re-circulation device of FIG. 5.
Figure 7:
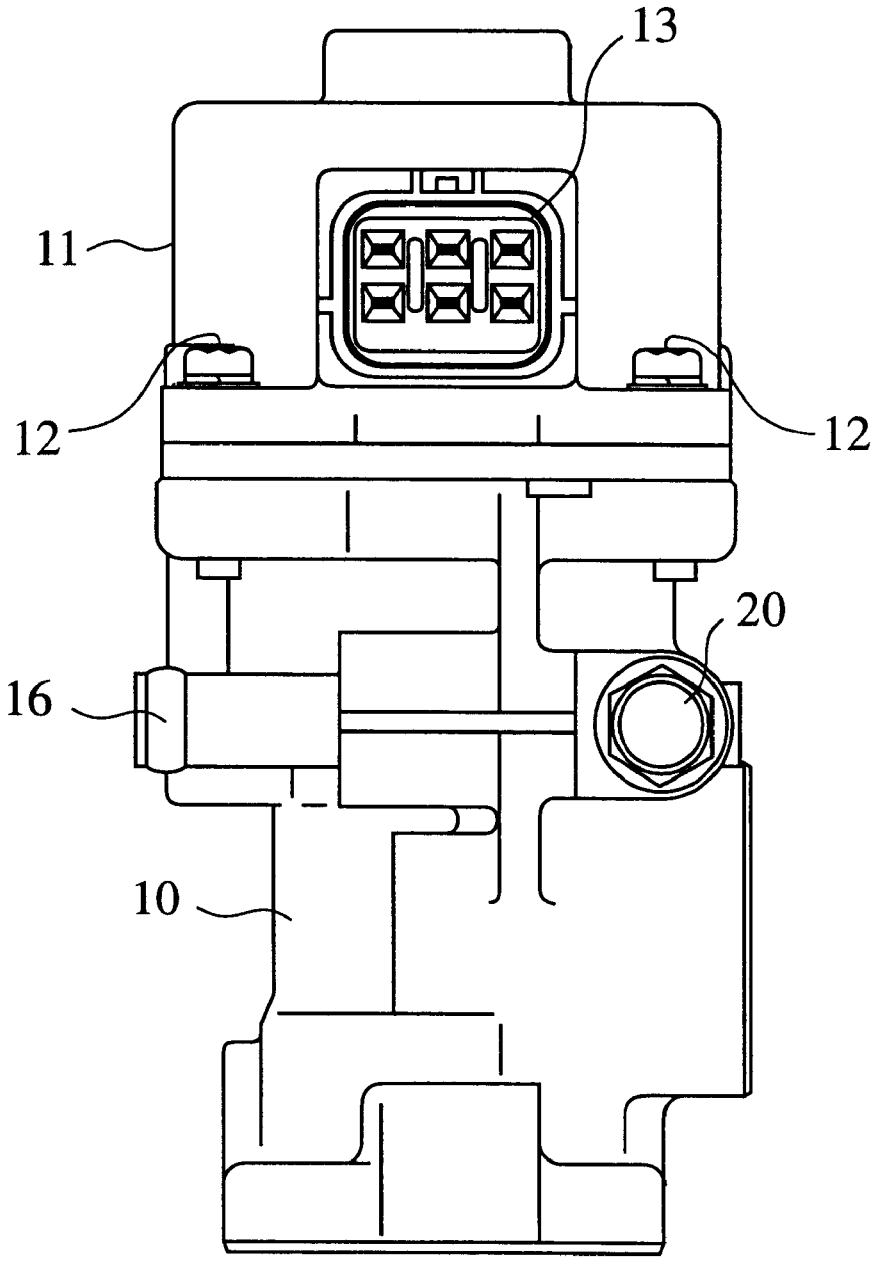
FIG. 7 is a side view of the water-cooled exhaust gas re-circulation device of FIG. 5.
Figure 8:
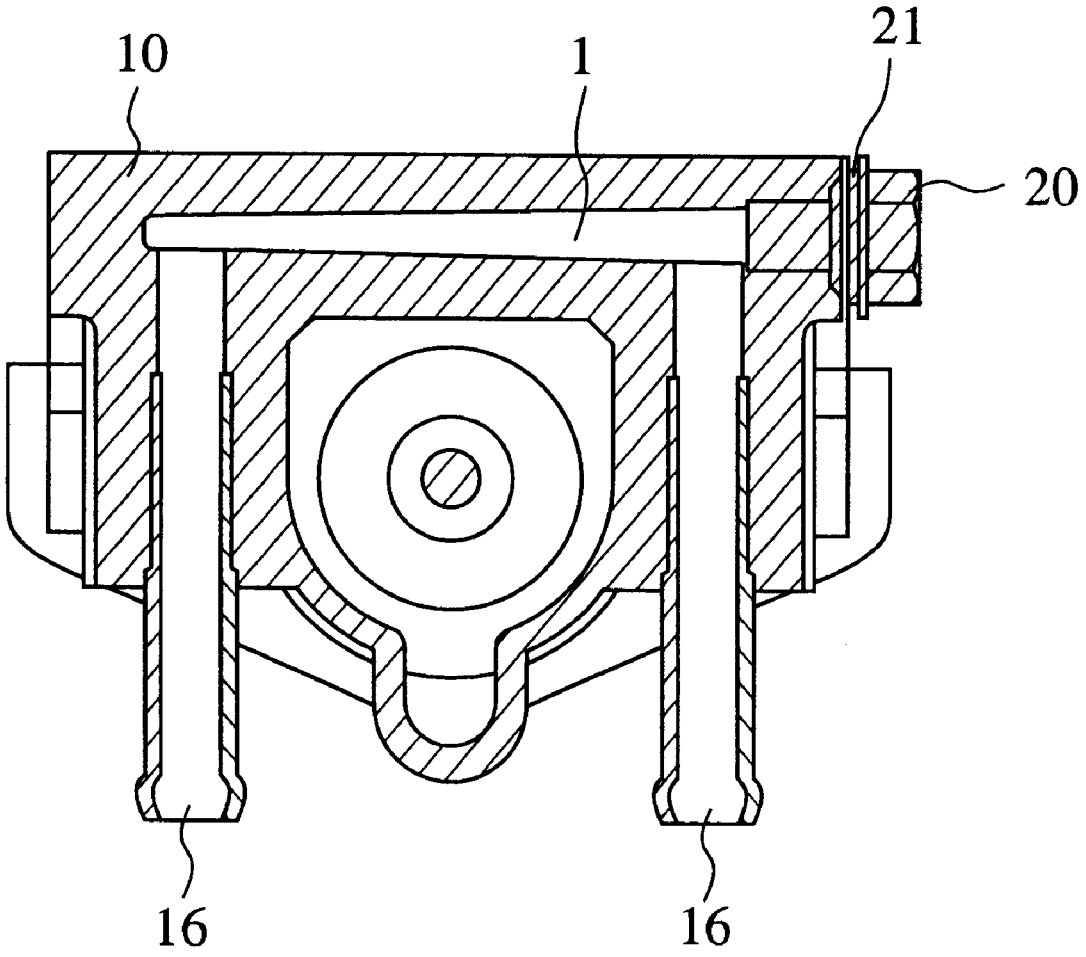
FIG. 8 is a cross sectional view taken along lines VIII—VIII of FIG. 5.
Figure 9A:
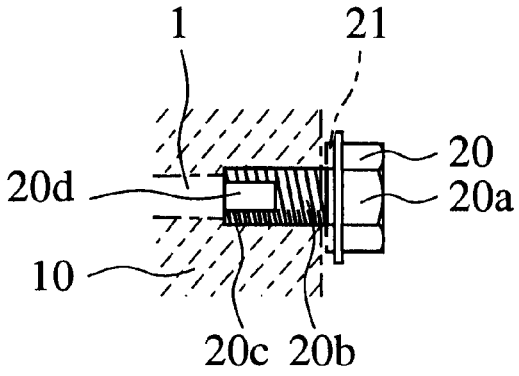
FIG. 9A is an enlarged plan view of a drain bolt of FIG. 8.
Figure 9B:
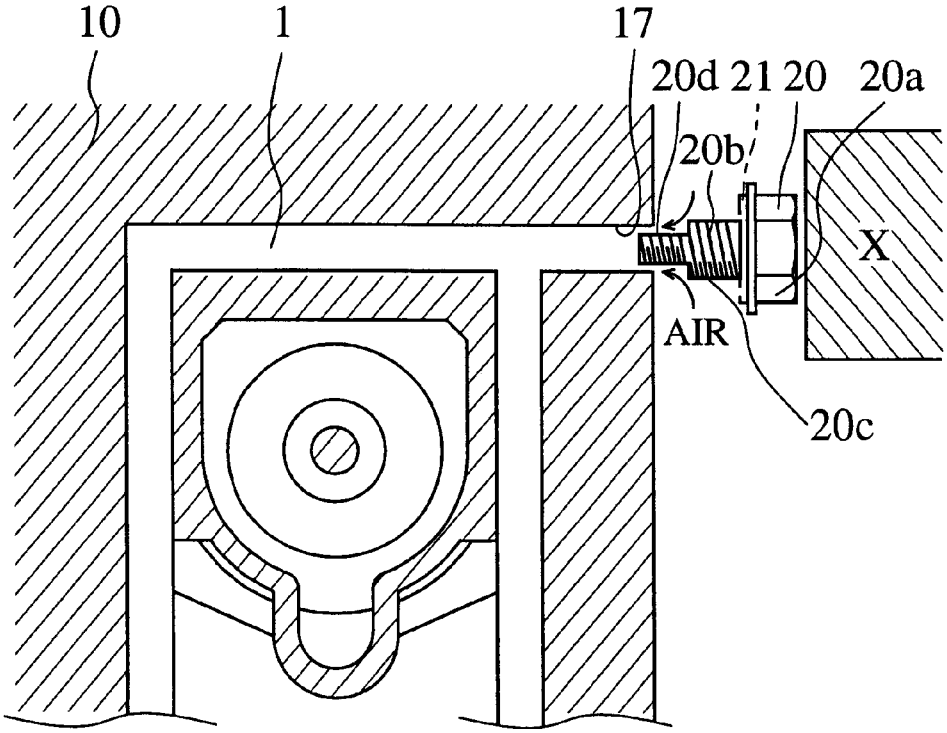
FIG. 9B is a plan view of a state of loosening the drain bolt of FIG. 9A inserted in a hole.
Figure 10:
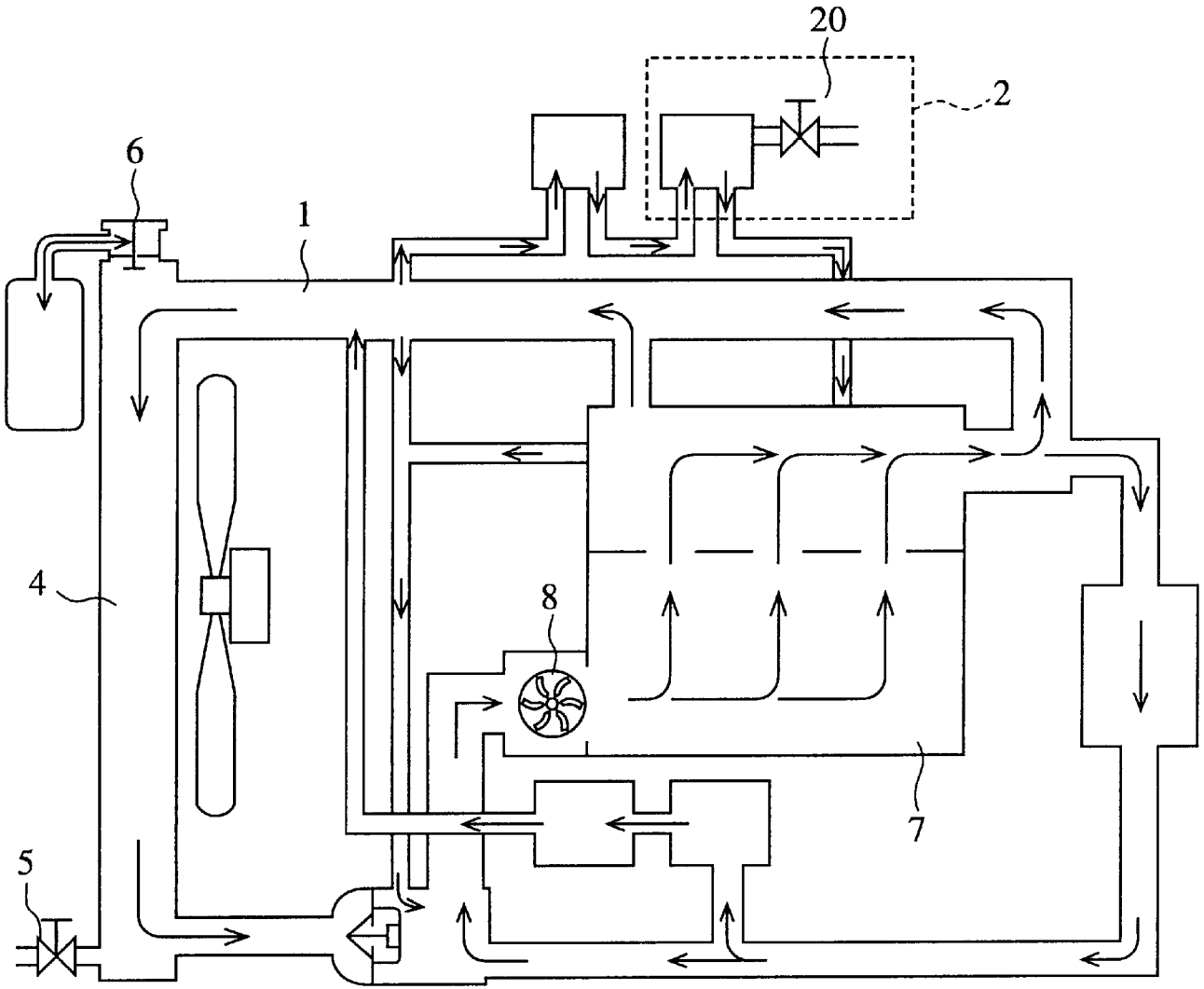
FIG. 10 illustrates a schematic representation of the whole of a cooling water re-circulation passage arranged at the internal combustion engine provided with the water-cooled exhaust gas re-circulation device as embodiment 1 according to the invention.

FIG. 5 is a front view of a water-cooled exhaust gas re-circulation device as embodiment 1 according to the invention. FIG. 6 is a plan view of the water-cooled exhaust gas re-circulation device of FIG. 5. FIG. 7 is a side view of the water-cooled exhaust gas re-circulation device of FIG. 5. FIG. 8 is a cross sectional view taken along lines VIII—VIII of FIG. 5. FIG. 9A is an enlarged plan view of a drain bolt of FIG. 8. FIG. 9B is a plan view of a state of loosening the drain bolt of FIG. 9A inserted in a hole. FIG. 10 illustrates a schematic representation of the whole of a cooling water re-circulation passage arranged at the internal combustion engine provided with the water-cooled exhaust gas re-circulation device as embodiment 1 according to the invention. Components of the embodiment 1 common to the conventional components are denoted by the same reference numerals and further description will be omitted.

In these drawings, a reference numeral 20 denotes a drain bolt, which is inserted rotationally into the hole 17, which is formed at the cooling water re-circulation passage 1 in a manufacturing step such as die casting and so on, through a packing 21. The drain bolt 20 includes a head section 20*a* having a major diameter, a leg section 20*b* having an outer diameter corresponding to an inner diameter of the hole 17, a threaded section 20*c* formed at an outer peripheral face of the leg section 20*b*, and a pair of notches 20*d* formed at a lower section of the leg section 20*b* in a chord or lateral direction as shown in FIG. 9A and FIG. 9B.

Next, an operation will be explained.

First, as shown in FIG. 10, to discharge the cooling water to change it to new one, the temperature of the cooling water is adequately reduced after stopping the engine. With the state, while adjusting an internal pressure of the cooling water re-circulation passage 1 due to open/close of the radiator cap 6, the radiator cap 6 is opened to introduce air to the cooling water re-circulation passage 1. The drain cock 5 is then opened to discharge the cooling water. The drain bolt 20, which acts as the air hole close to the engine and is integrated with the water-cooled exhaust gas device, is rotated to loosen it. In this way, air is introduced to the cooling water re-circulation passage 1 through a gap defined between the notches 20*d* of the drain bolt 20 and an inner peripheral wall of the hole 17. The cooling water close to the engine is then conveyed toward the radiator to discharge it to outside through the drain cock 5.

Next, to supply the cooling water to the passage 1, the required amount of the cooling water is supplied to the passage 1 through the radiator cap 6 after the drain cock 5 is closed. When the cooling water is supplied, the drain bolt 20 being integrated with the water-cooled exhaust gas re-circulation device is loosened. In this way, the drain bolt 20 acts as an air hole discharging smoothly air in the cooling water re-circulation passage 1 to outside. Thus, the air communication through the drain bolt 20 can be performed only by opening and closing the drain bolt 20. Even if an interference substance X is close to the drain bolt 20 as shown in FIG. 9B, it is possible to supply air to the cooling water re-circulation passage 1 or to discharge air therefrom through a slight space close to the head section 20*a* of the drain bolt 20 using the drain bolt 20 without removing it.

As described above, according to the embodiment 1, the drain bolt 20 acting as the hole-open/close mechanism is integrated with the cooling water re-circulation passage 1 to result in removing the conventional drain bolt 3 independent of the exhaust gas re-circulation valve. In this way, it is possible to allow saving space, simplifying the structure and reducing a component count.

With the embodiment 1, even if the interference substance X is close to the drain bolt 20, it is possible to ensure an air hole with respect to the cooling water re-circulation passage 1 without removing the drain bolt 20.

With the embodiment 1, the drain bolt 20 acting as the hole-open/close mechanism is arranged in the hole 17 formed at the cooling water re-circulation passage 1 due to the die casting. In this way, it is not necessary to form an exclusive hole, at the cooling water re-circulation passage 1 in order to install the hole-open/close mechanism. It is possible to allow reducing costs and saving a space as compared with a case of forming the exclusive hole.

Moreover, with the embodiment, the drain bolt 20 acting as the hole-open/close mechanism is arranged in the hole 17 formed at the cooling water re-circulation passage 1 due to the die casting. Alternatively, the drain bolt 20 may be arranged at the cooling water re-circulation passage 1 other than the hole 17 to allow communicating with outside. With the embodiment 1, the drain bolt 20 is used as the hole-open/close mechanism. Alternatively, the invention is not limited to this embodiment.

INDUSTRIAL APPLICABILITY

As apparent from the foregoing, with the water-cooled exhaust gas re-circulation device according to the invention, the drain bolt acting as the hole-open/close mechanism is integrated with the cooling water re-circulation passage to result in removing the conventional drain bolt independent of the exhaust gas re-circulation valve. In this way, it is possible to allow saving a space, simplifying the structure and reducing a component count.

What is claimed is:

1. A water-cooled exhaust gas re-circulation device wherein a hole-open/close mechanism allowing communication with outside air is provided at a valve body of said water-cooled exhaust gas re-circulation device; and wherein a cooling water re-circulation passage cools an exhaust gas re-circulation valve within said valve body.

2. A water-cooled exhaust gas re-circulation device according to claim 1, wherein the hole-open/close mechanism is a drain bolt.

3. A water-cooled exhaust gas re-circulation device according to claim 1, wherein the hole-open/close mechanism is arranged at a stopper stopping up a hole formed during manufacturing the cooling water re-circulation passage.

4. A water-cooled exhaust gas re-circulation device according to claim 1, wherein said hole-open/close mechanism and said water-cooled exhaust gas re-circulation device are integral.

5. A water-cooled exhaust gas re-circulation device according to claim 1, wherein said hole-open/close mechanism is arranged in a hole formed in said valve body by die casting.

6. A water-cooled exhaust gas re-circulation device according to claim 3, wherein said hole is formed by die casting.

* * * * *